US005343911A

United States Patent [19]

Humphrey

[11] Patent Number: 5,343,911

[45] Date of Patent: Sep. 6, 1994

[54] STAVE-CUTTING MACHINE

[76] Inventor: Thomas Humphrey, 342 W. Main St., Lebanon, Ky. 40033

[21] Appl. No.: 114,735

[22] Filed: Aug. 30, 1993

[51] Int. Cl.[5] ..... B27M 3/00; B27C 5/00

[52] U.S. Cl. ..... 144/134 R; 144/2 R; 144/49; 144/30; 144/278 R; 144/363

[58] Field of Search ..... 147/34; 144/2 R, 30, 144/49, 134 R, 142, 144 R, 146, 278 R, 363; 269/27, 32, 20

[56] References Cited

U.S. PATENT DOCUMENTS

| | | | |
|---|---|---|---|
| 118,387 | 8/1871 | Palmer . | |
| 130,739 | 8/1872 | Palmer . | |
| 186,704 | 1/1877 | Arbey . | |
| 942,799 | 12/1909 | Taylor . | |
| 1,028,648 | 6/1912 | Williams . | |
| 3,719,216 | 3/1973 | Tracy | 144/30 |
| 4,387,751 | 6/1983 | Carter | 144/30 |
| 5,176,060 | 1/1993 | Thornton | 144/30 |

OTHER PUBLICATIONS

Sketch of old cuting wheel.

*Primary Examiner*—W. Donald Bray
*Attorney, Agent, or Firm*—Camoriano & Smith

[57] ABSTRACT

A stave-cutting machine has a cutter head mounted on a pivot arm, and the pivoting of said pivot arm about an axis orthogonal to the longitudinal axis of the stave defines the bilge of the stave.

7 Claims, 12 Drawing Sheets

STAVE-CUTTING MACHINE

BACKGROUND OF THE INVENTION

The present invention relates to the barrel-making or cooperage industry, and, in particular, to a machine which cuts staves for making barrels.

FIG. 1 shows a typical barrel 10 made up of staves 12 tied together with hoops 14. When producing a given type of barrel, all the barrels are made with the same number of staves. In order for the staves to fit together properly, the edges of the staves are cut with an angle alpha, shown in FIG. 3. This angle is called the flare angle. The angle alpha is 360° divided by the number of staves in the barrel.

In order for the barrel 10 to have a barrel shape, with the center having a wider diameter than the ends, the staves 12 must be bowed, having a wider center than ends. FIG. 4 shows a stave 12, and the amount of bow, called the bilge, is shown at 16. The longitudinal axis 18 of the stave 12 is an imaginary line dividing the stave in half lengthwise. The grain of the wood in the stave runs lengthwise as well, parallel to the longitudinal axis 18. The midpoint 20 of the stave is halfway between the ends 22.

When the barrel is assembled, the flat staves are bowed and tied together with hoops 14. A cross-section of the assembled barrel is shown in FIG. 2.

The stave blanks which arrive at the barrel factory from the lumber mill have straight sides and ends as shown in dotted lines in FIGS. 3 and 4. At the barrel factory, the flare angle alpha and the bilge 16 must be cut into the stave blanks. In order for the barrels to be of high quality, the cuts must be very accurate on every stave. It is also important for the person operating the stave cutting machine to have good control of where the cut will be, to avoid wasting wood. It is also important for the cutting process to proceed quickly, in order to manufacture the staves efficiently.

The cooperage industry is a very old industry, and the prior art for stave-cutting machines goes back many years. Machines such as that shown in U.S. Pat. No. 942,799 "Taylor" (1909) have a saw on a horizontal carriage. In order to cut a stave lying horizontally, the saw blade rotates about an axis which is substantially horizontal but is tilted at the angle of the flare, and the carriage takes the saw along a track which follows the path of the bilge, so as to cut the properly-shaped edge on a stave. The saw cuts into the front face of the stave. Then the half-cut stave is removed from the machine, is turned around, and the saw makes another run along the track. In general, this type of machine is built to make only one size and shape of barrel. U.S. Pat. No. 186,704 "Arbey" (1877) also has a saw running horizontally, but it has the stave rocking back and forth to create the bilge.

It is also known to cut staves with a machine which has a large cutter wheel rotating about an almost horizontal axis (at a slight angle to provide the flare angle), with the wheel having angled knives projecting out of its front face. The horizontal stave is then pushed into the large cutter wheel, and, since the angled knives are farther away from the stave at the center than at the ends, the knives cut the bilge shape on the stave. Again, these machines are not adjustable. They are made to cut a single size and shape of stave. Also, they tend to waste wood, because it is very easy to push the stave into the cutter wheel too far, thereby cutting away more wood than necessary in making the stave. Because the cutter wheel in these machines is so large, it cannot rotate at very high speeds (rotates at about 800 rpm) and therefore tends to tear away chunks of wood, again wasting material. In this type of machine, as in other prior art machines, the cutter knives impact the stave's front face.

SUMMARY OF THE INVENTION

The present invention provides a stave-cutting machine which is very different from the machines of the prior art and which, as a result of its different design, provides a cleaner, more accurate cut than the machines of the prior art. The machine of the present invention also can readily be adjusted to cut various sizes and shapes of staves, so it is not necessary to buy an entirely new machine in order to make a new size or shape of barrel.

The present invention provides a stave-cutting machine with a cutting head which cuts along the edge of the wood rather than along the front face.

The present invention provides a stave-cutting machine in which the cutter head can rotate at very high speeds (i.e. 4,500 rpm), thereby greatly reducing the amount of waste from tearing the wood.

The present invention provides a stave-cutting machine which is easier to operate and which wastes much less wood than prior art machines.

The present invention provides a stave-cutting machine which is computer-controlled for improved accuracy and ease of use.

DESCRIPTION OF THE PREFERRED EMBODIMENT

Cutting the flare angle and the bilge into the stave is a relatively complicated cut. The machine of the present invention makes that cut quickly, cleanly, and accurately.

Figure 5:
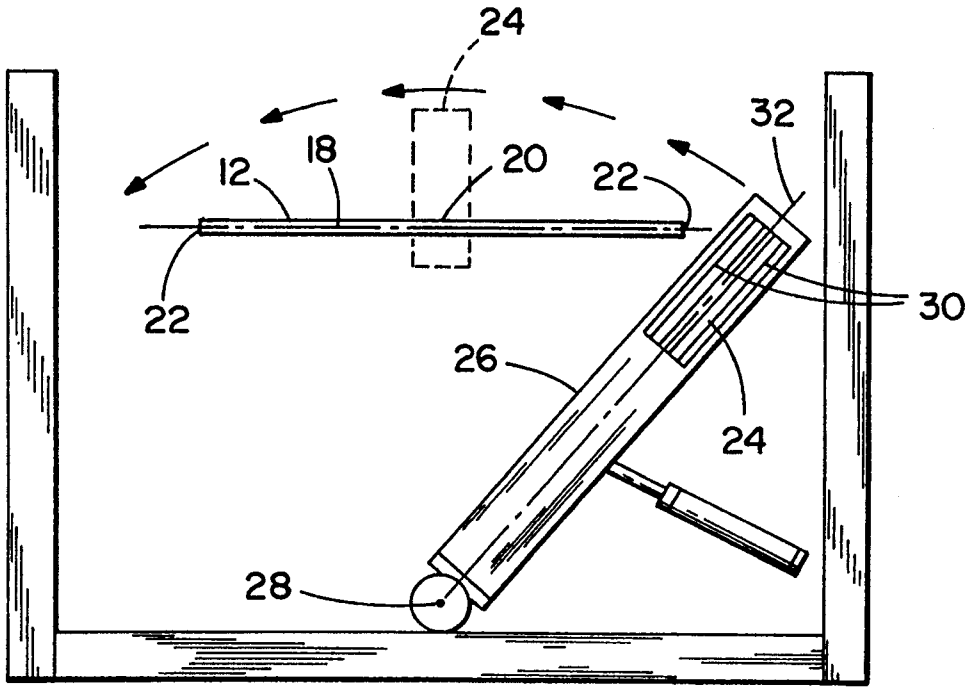
FIG. 5 is a schematic front view of the stave-cutting machine of the present invention.

The preferred embodiment of the machine of the present invention is shown schematically in FIG. 5. The machine includes a mechanism (not shown in FIG. 5) for holding the stave blank in place so as to define the longitudinal axis 18 and midpoint 20 of the stave. The cutter head 24 is mounted on a pivot arm 26, which pivots about a pivot axis 28.

The pivot axis 28 is in line with the midpoint 20 of the stave blank, meaning that the pivot axis 28 lies in an imaginary plane which is perpendicular to the longitudinal axis of the stave at the midpoint 20. The pivot axis 28 is orthogonal to the longitudinal stave axis 18 (meaning that the direction of the pivot axis 28 is perpendicular to the direction of the longitudinal stave axis 18, even though the two axes 28, 18 do not lie in the same plane). The cutter head 24 has several cutter knives 30 mounted parallel to and forming a cylinder around the cutter axis of rotation 32 (shown in FIG. 6).

Figure 1:
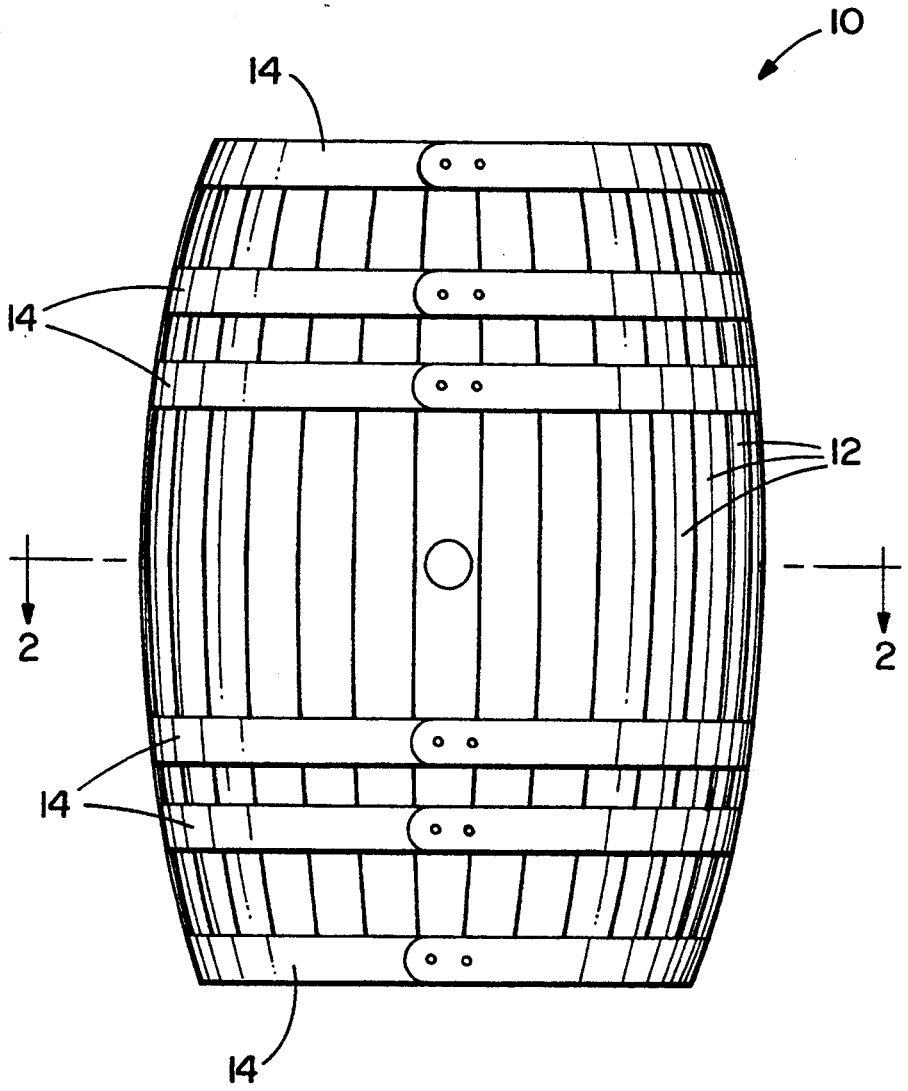
FIG. 1 PRIOR ART
FIG. 1 is a view of a typical barrel.
Figure 2:
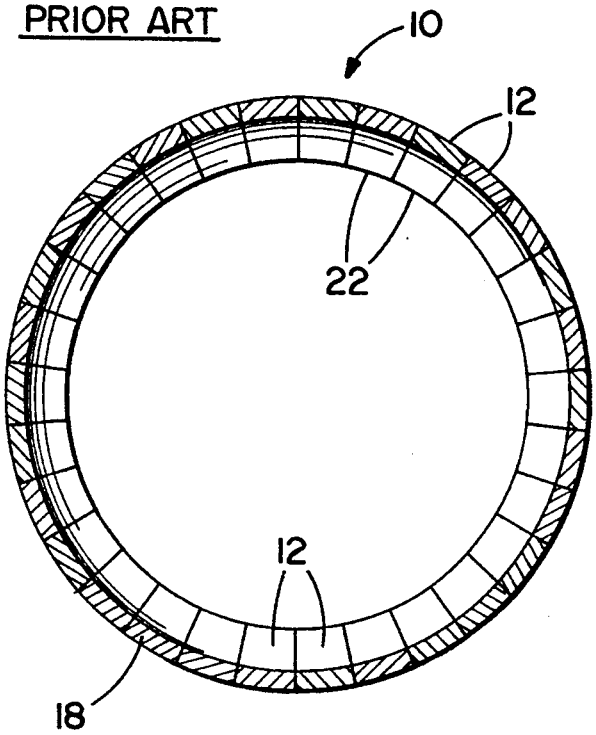
FIG. 2 PRIOR ART
FIG. 2 is a sectional view of the barrel of FIG. 1.
Figure 3:
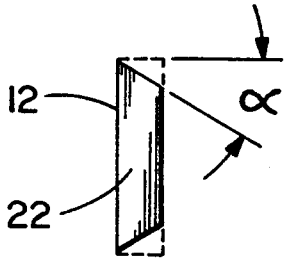
FIG. 3 PRIOR ART
FIG. 3 is a view of just the end of one of the staves of the barrel of FIG. 1, with the end of the block of wood from which the stave was cut shown in dotted lines.
Figure 4:
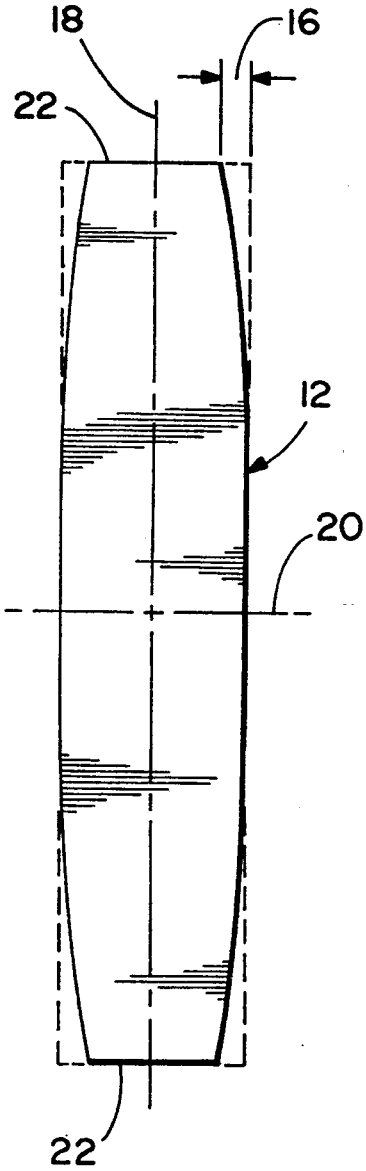
FIG. 4 PRIOR ART
FIG. 4 is a front view of one of the staves of FIG. 1, with the blank piece of wood from which the stave was cut shown in dotted lines.
Figure 6:
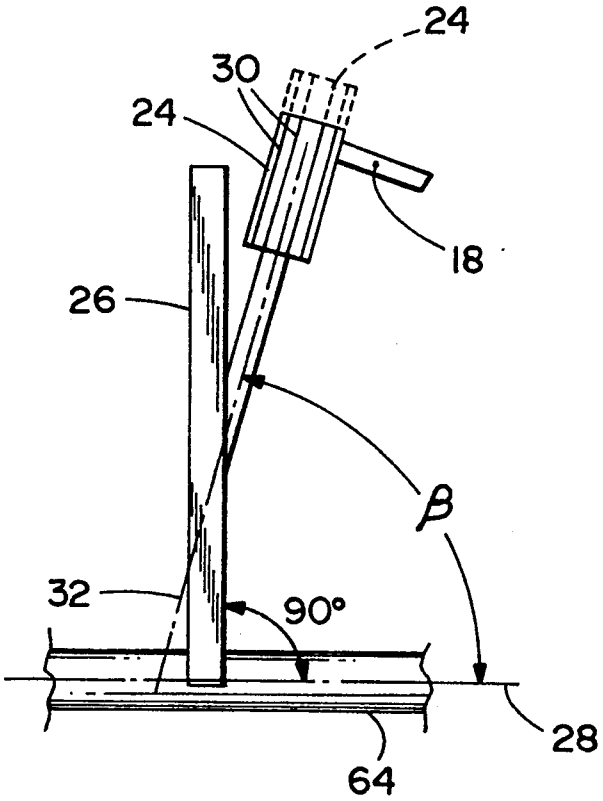
FIG. 6 is a schematic left side view of the machine of FIG. 5.

As can be seen in FIG. 6, the axis of rotation 32 of the cutter head 24 is not at right angles to the pivot axis, as is the pivot arm 26, but lies at an angle beta to the pivot axis 28 (the angle beta being less than 90°). This means that axis of rotation of the cutter head 24 traces out an imaginary portion of a cone (a frustro-conical shape) as the pivot arm 26 pivots about the pivot axis 28. Since each cutter knife 30 is parallel to the axis of rotation of the cutter head 24, each cutter knife 30 also traces out an imaginary portion of a cone as the pivot arm pivots about the pivot axis 28. The cut that is made in the stave is the intersection of the portion of the cone traced by the cutter knife and the plane defined by the stave (in other words, where the knife contacts the stave).

FIG. 5 shows that, as the pivot arm 26 pivots about the pivot axis 28, the height of the cutter head 24 relative to the longitudinal axis 18 of the stave 12 changes, so that, when the cutter head is cutting the ends of the stave, it is low and the upper part of the cutter head is doing the cutting, and, as the cutter head approaches the midpoint 20 of the stave 12, it is higher, and a lower part of the cutter head 24 is doing the cutting. Since the knives or cutting edges 30 of the cutter head 24, being parallel to the axis of rotation 32, also lie at the angle beta to the pivot axis 28, the upper part of the knives 30 cuts away more material (cuts closer to the longitudinal axis 18 of the stave), and the lower part of the knives 30 cuts away less material (cuts farther away from the longitudinal axis 18 of the stave), thereby creating the bow shape or bilge 16. The angle between the cutter knife 30 and the edge of the stave blank defines the flare angle alpha.

It should be noted that in this device, unlike other known stave cutting devices, the cut is made into the edge of the stave blank rather than into the face of the stave blank.

In order to adjust the machine to make it able to cut various sizes and shapes of staves, the angle beta between the cutter knives and the pivot axis 28 can be adjusted, and the angle alpha can be adjusted by adjusting the clamp mechanism which holds the stave blank. Thus, the machine of the present invention can be used to make small barrels and large barrels, with staves as short as 30 inches and as long as 45 inches, whereas other machines, if they are adjustable at all, are adjustable only within a very narrow range of lengths.

Figure 7:
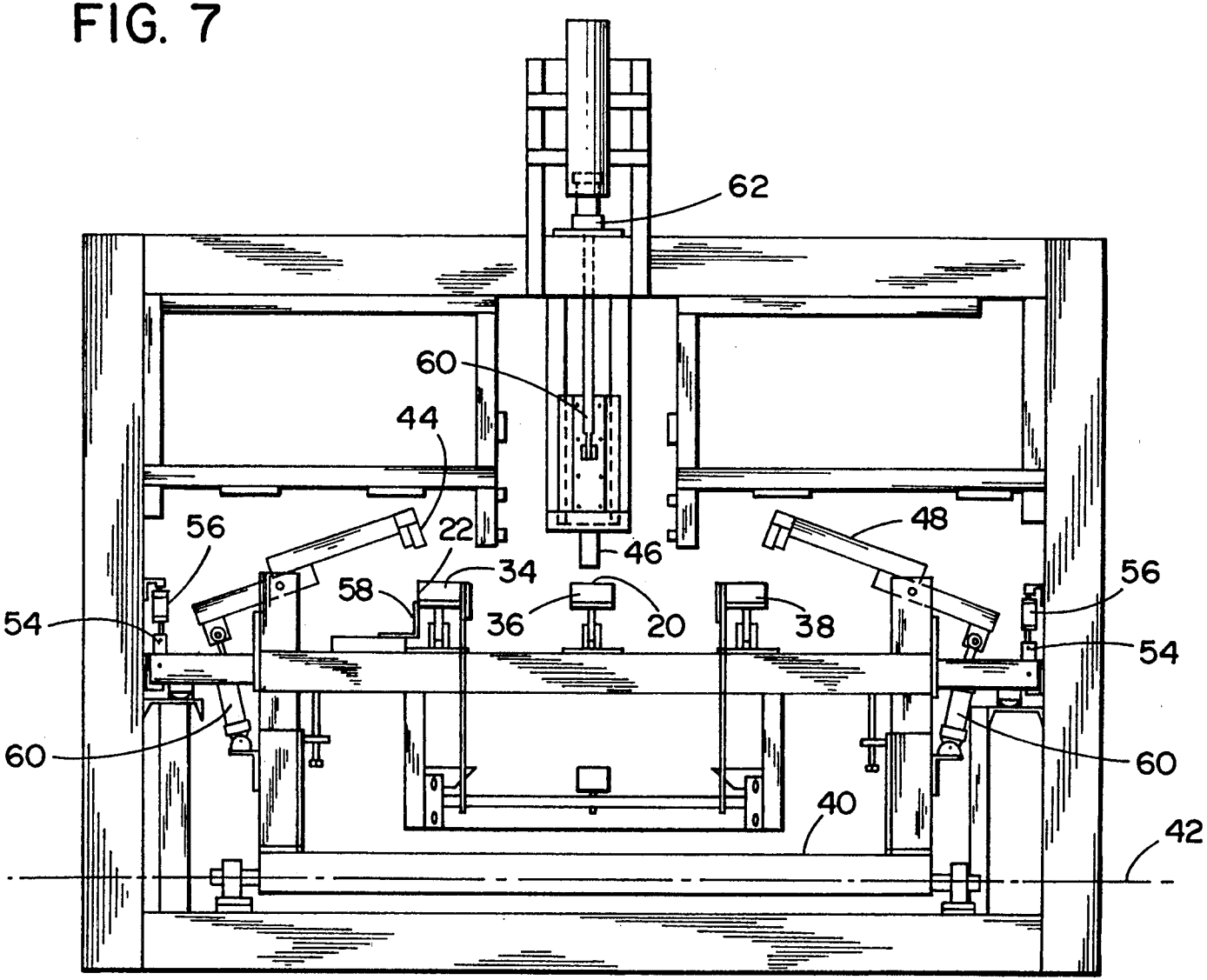
FIG. 7 is a more detailed front view of the machine of the stave-cutting machine of the present invention, with the cutter mechanism removed for clarity.

Looking at the preferred embodiment of the machine in more detail now, FIG. 7 shows the front of the machine, with the cutter head 24 and pivot arm 26 removed for clarity. In the front are three stave cradles 34, 36, 38, which receive and support a stave blank (not shown), defining the longitudinal axis 18 and midpoint 20 of the stave. The stave cradles 34, 36, 38 can be adjusted up and down, and the angle of the stave cradles 34, 36, 38 can be adjusted to change the flare angle alpha. The stave cradles 34, 36, 38 are mounted on a frame 40 which pivots about an axis 42 at the bottom of the frame. The frame 40 pivots to a forward position, away from the cutter head, for mounting the stave blank in the cradles 34, 36, 38, and then pivots to a fixed cutting position, resting against fixed stops 50, 52, to be cut. There is a small strip of material 54 lying against the front of each stop 50, 52. These small strips of material 54 are called recut cams. They are mounted on hydraulic cylinders 56 and can be lifted up, so that the frame can pivot toward the cutter head a slightly greater distance. The function of the recut cams will be described in more detail later.

Three clamps 44, 46, 48 are provided to clamp the stave blank against the cradles 34, 36, 38 respectively. The clamps 44, 48 are also mounted on the frame 40, so they hold the stave blank fixed in the cradles as the frame 40 pivots forward into the cutting position. The clamps are controlled by hydraulic cylinders 60. There is also an end stop 58 to the left of the left-most cradle 34, and the left end of each stave blank is pushed up against that left end stop 58 before being clamped in place.

There is a laser beam 62 mounted at the top front of the machine. An adjustable lens (not shown) is mounted below the laser beam source so that a curved line shines down on the cradles 34, 36, 38 to show where the cut will be made. When a stave blank is placed on the cradles 34, 36, 38, the laser beam shows the operator where the machine will cut the blank, so the operator can move the blank toward the cutter head or away from the cutter head until he sees that the cut will be in the correct location on the blank. When the operator determines that the blank is correctly positioned, he steps on a control switch which activates a hydraulic cylinder (not shown in this figure), causing the cradle frame 40 to pivot about its axis 42 until it contacts the recut cams 54 lying in front of the stops 50, 52.

Figure 8:
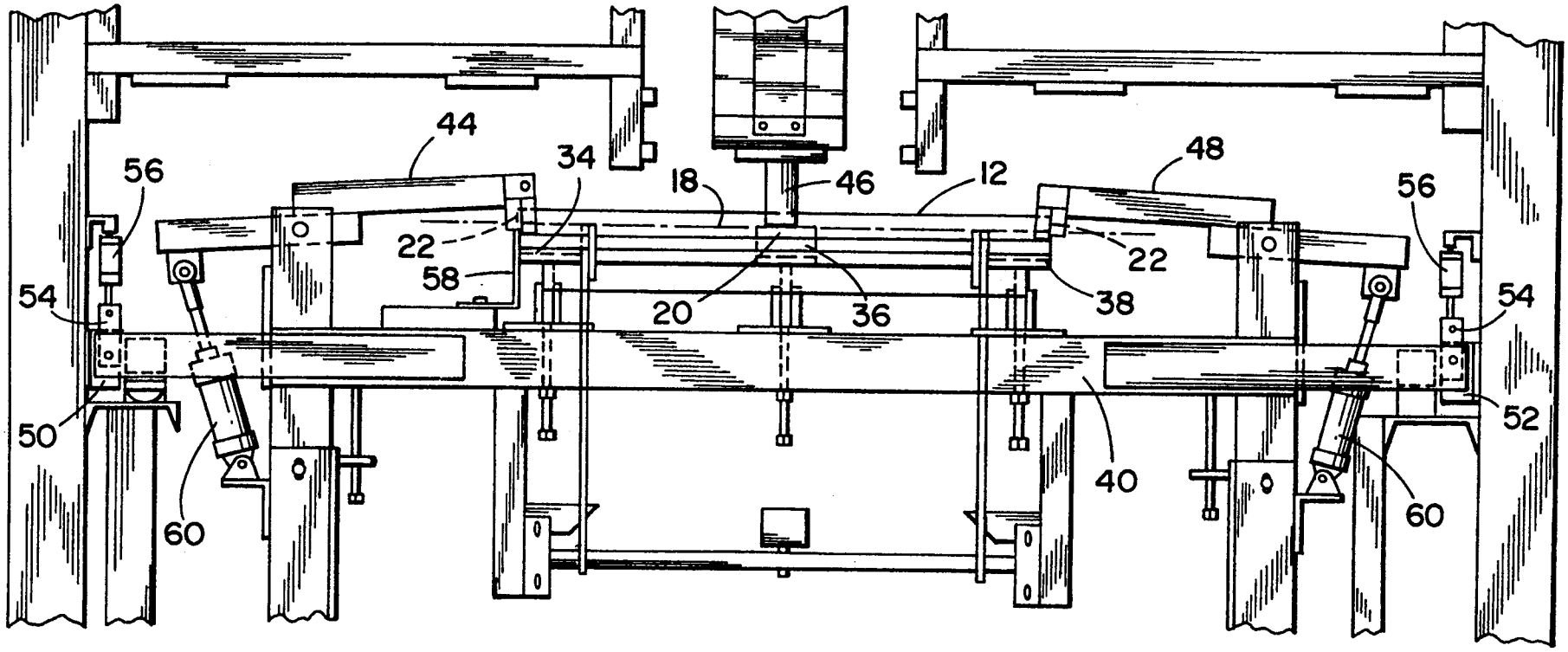
FIG. 8 is an enlarged, broken-away front view of the machine of FIG. 7, with a stave clamped in the machine and with the cutting mechanism removed.
Figure 9:
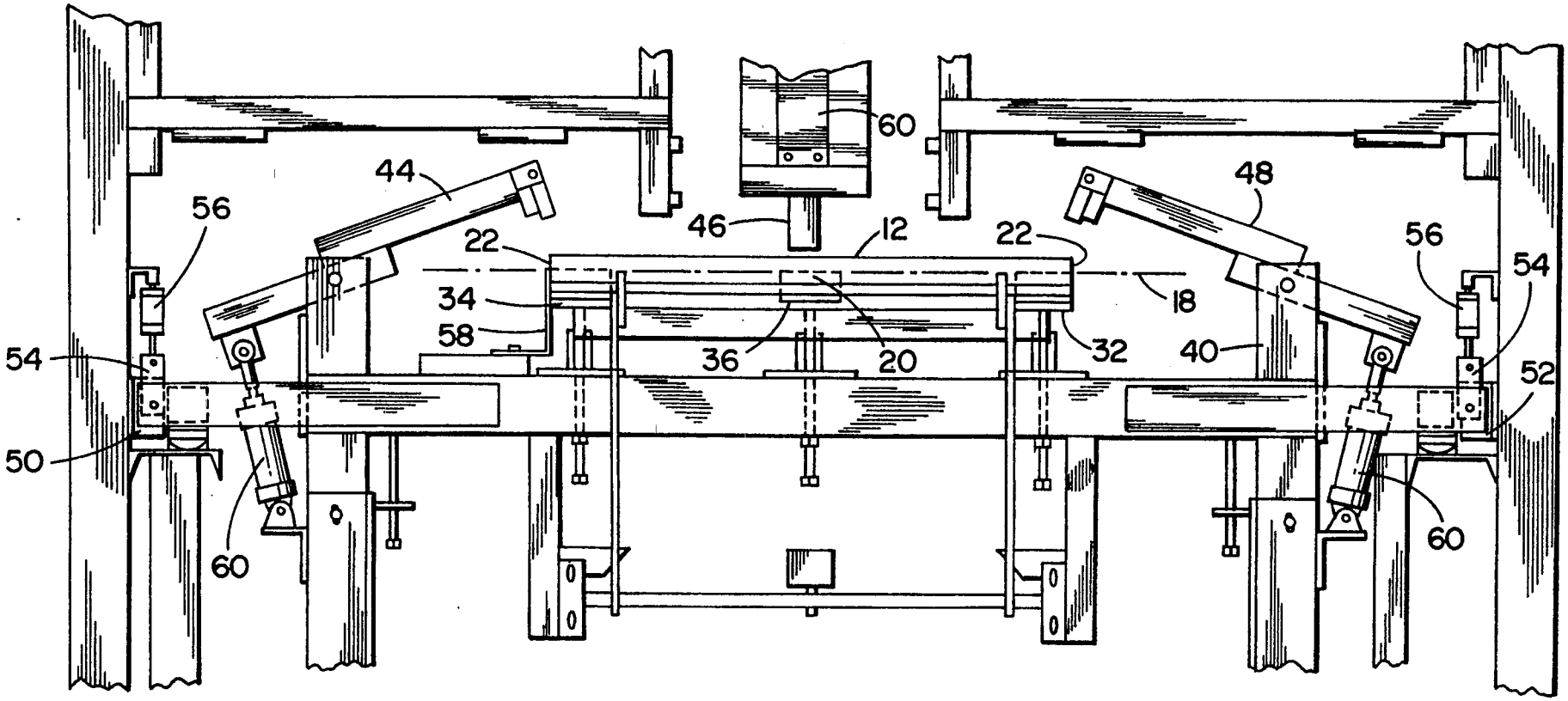
FIG. 9 is the same view as FIG. 8, but with the clamping mechanism released from the stave.

FIG. 8 is a front view, showing the stave blank clamped on the clamping frame 40 and pivoted forward against the stops for cutting. The clamps 44, 46, 48 are pressing against the top of the stave 12, forcing the stave 12 down against the cradles 34, 36, 38. The left end of the stave 12 is against the end stop 58. FIG. 9 is the same view as FIG. 8, but with the clamps up, releasing the stave 12 after it has been cut.

Figure 10:
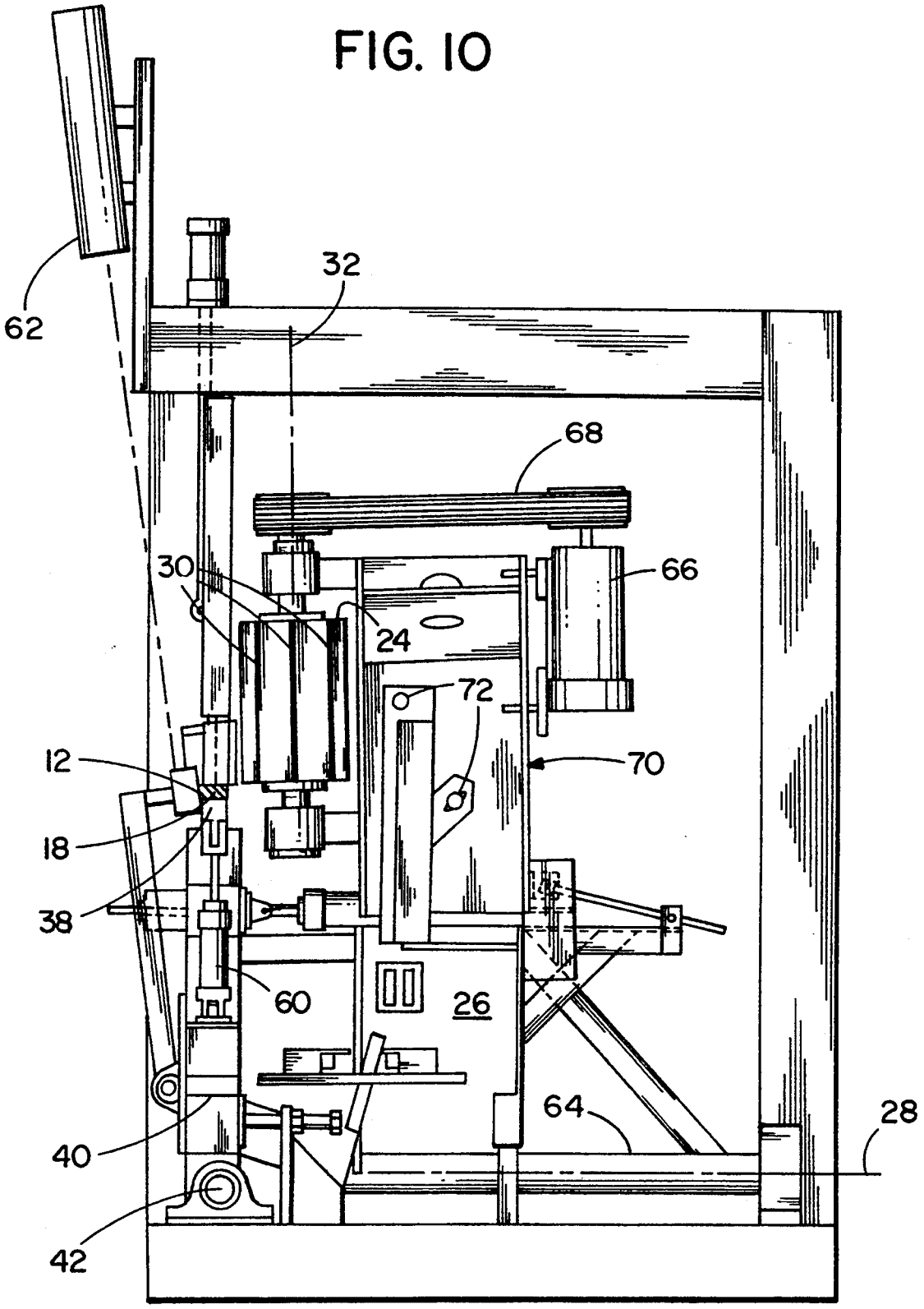
FIG. 10 is a right side view of the machine of FIG. 7, with the cutting mechanism in place and showing a stave being cut.

FIG. 10 is a right side sectional view of the machine in the position shown in FIG. 8, with the stave 12 clamped onto the frame 40 and pivoted into the machine, against the stop, so it is in the cutting position. This view shows the pivot arm 26, the pivot shaft 64, which defines the pivot axis 28, the cutter head 24, the cutter knives 30, and the motor 66, which drives the cutter head 24 by means of a belt 68. The cutter head axis of rotation 32 is at an angle to the pivot axis of slightly less than 90° while the pivot arm 26 is at right angles to the pivot axis 28. The cutter head 24 and drive motor 66 are mounted on a cutter head frame 70, which mounts to the pivot arm 26 by means of bolts 72. There are slots on the cutter head frame 70 which permit the angle beta to be adjusted by loosening the bolts 72, adjusting the angle between the cutter head frame and the pivot arm 26, and then tightening the bolts 72.

Figure 11:
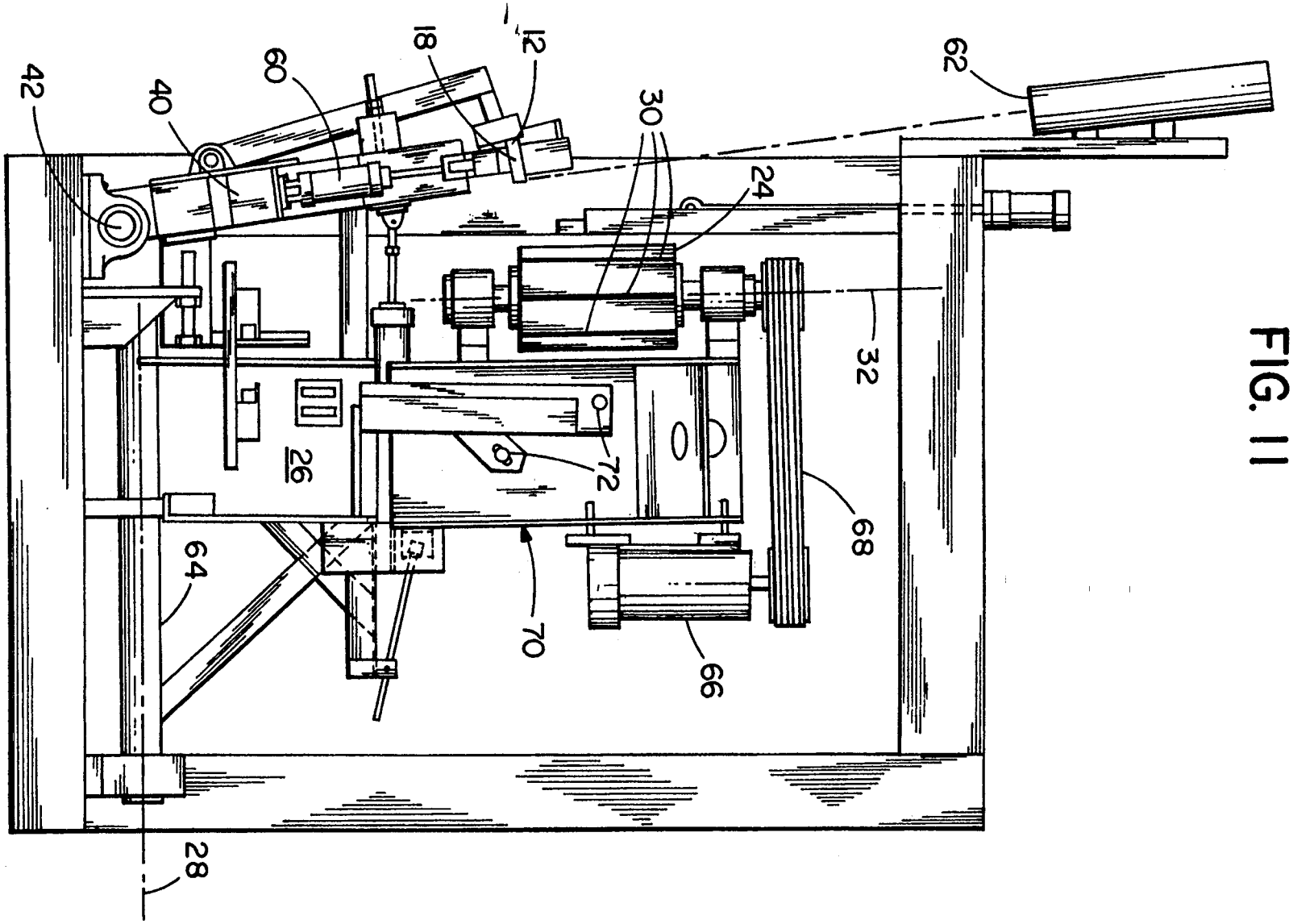
FIG. 11 is the same view as FIG. 10, but with the stave in the forward position (for insertion or removal of the stave from the machine)

FIG. 11 is the same view as FIG. 10, except that the clamping frame 40 is pivoted outward, away from the cutter head. In this position, it can be seen that the laser beam shines down on the stave blank 12, indicating where the cut will be made.

Figure 12:
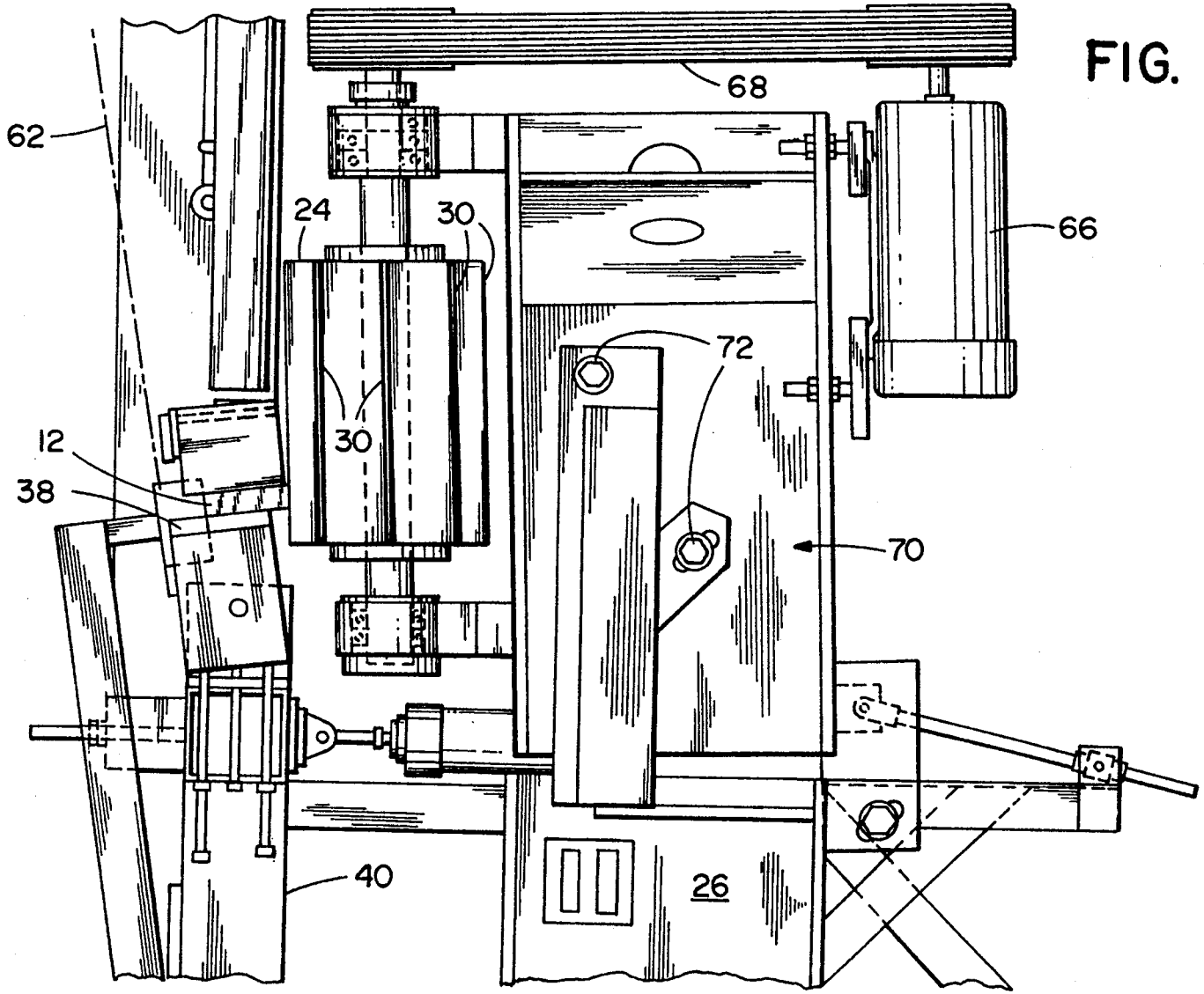
FIG. 12 is an enlarged, broken-away portion of the view shown in FIG. 10.

FIG. 12 is an enlarged view, showing the stave 12 being cut by the cutter head. The cutter head 24 is approximately at the midpoint 20 in this view, and it can be seen that the lower portion of the cutter head 24 is cutting the stave at this point. If the cutter head were cutting one of the ends of the stave 12, we would see the cutter head contacting the stave at a higher point on the cutter head, where it would cut away more material, since the cutter knives are at an angle to the longitudinal axis of the stave 12.

Figure 13:
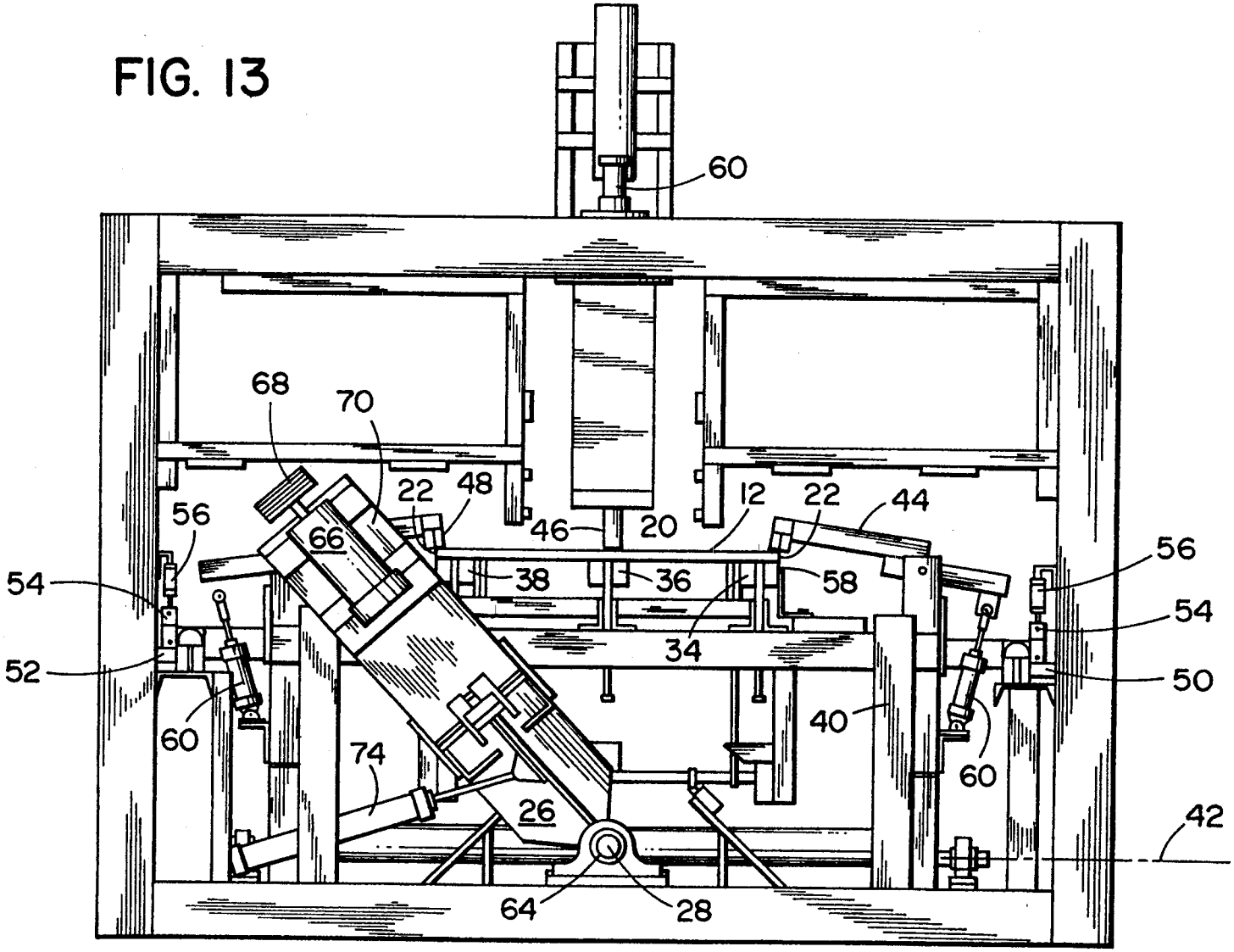
FIG. 13 is a back sectional view of the machine of FIG. 7, with the cutter head at the right end, either ready to cut or after having finished cutting a stave.

FIG. 13 is a back view of the machine, with the back enclosure wall of the machine removed so the mechanism is visible. In this view is shown the stave 12 clamped in place by the clamps 44, 46, 48. The hydraulic cylinder 74, which moves the pivot arm 26 back and forth about the pivot axis 28, is also shown. In this view, the cutter head is past the right end of the stave 12, the position before the cut is made.

Figure 14:
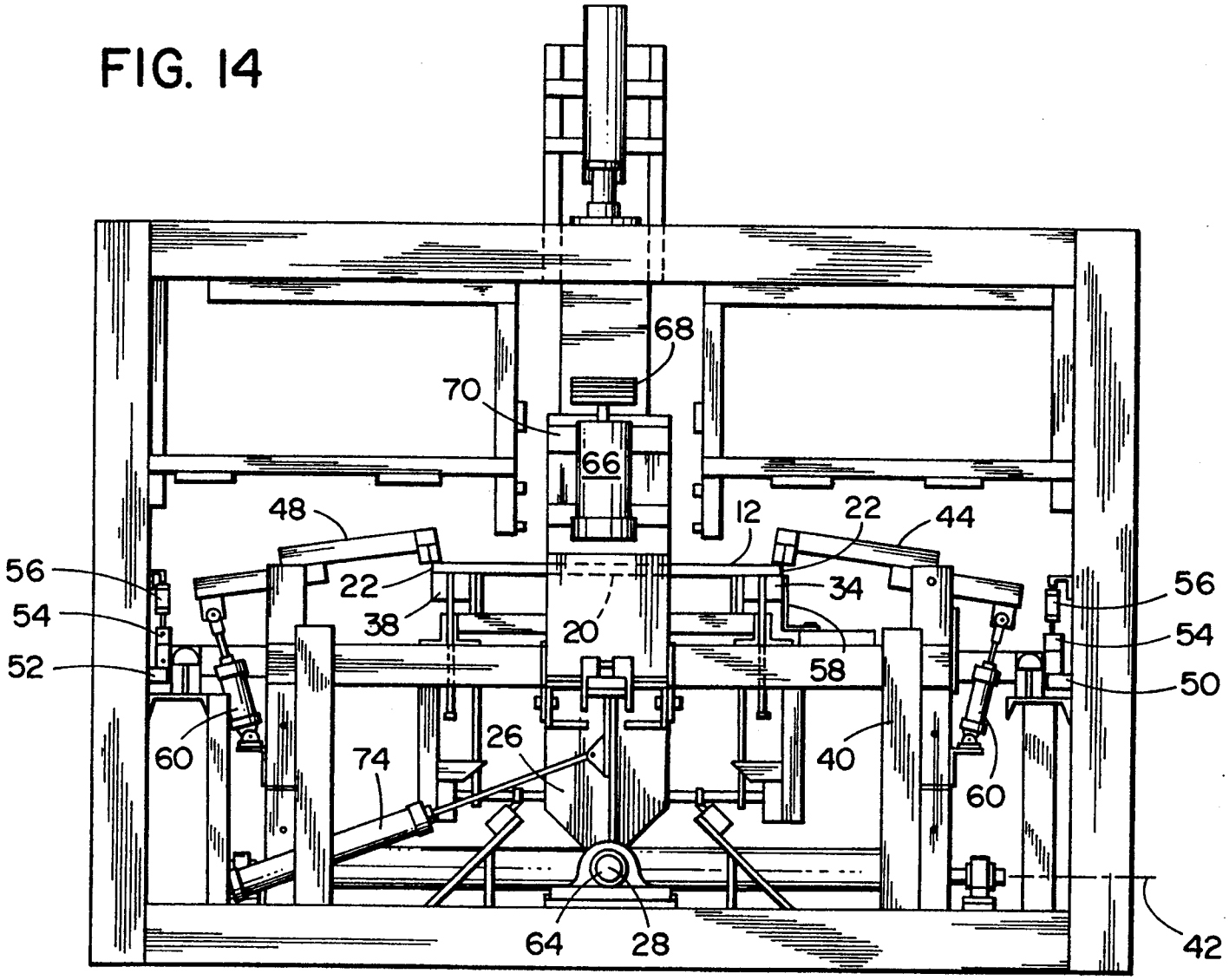
FIG. 14 is the same view as FIG. 14, but with the cutter head half-way through the cut.

FIG. 14 shows the pivot arm 26 in a vertical position, with the cutter head 24 cutting the midpoint 20 of the stave 12.

Figure 15:
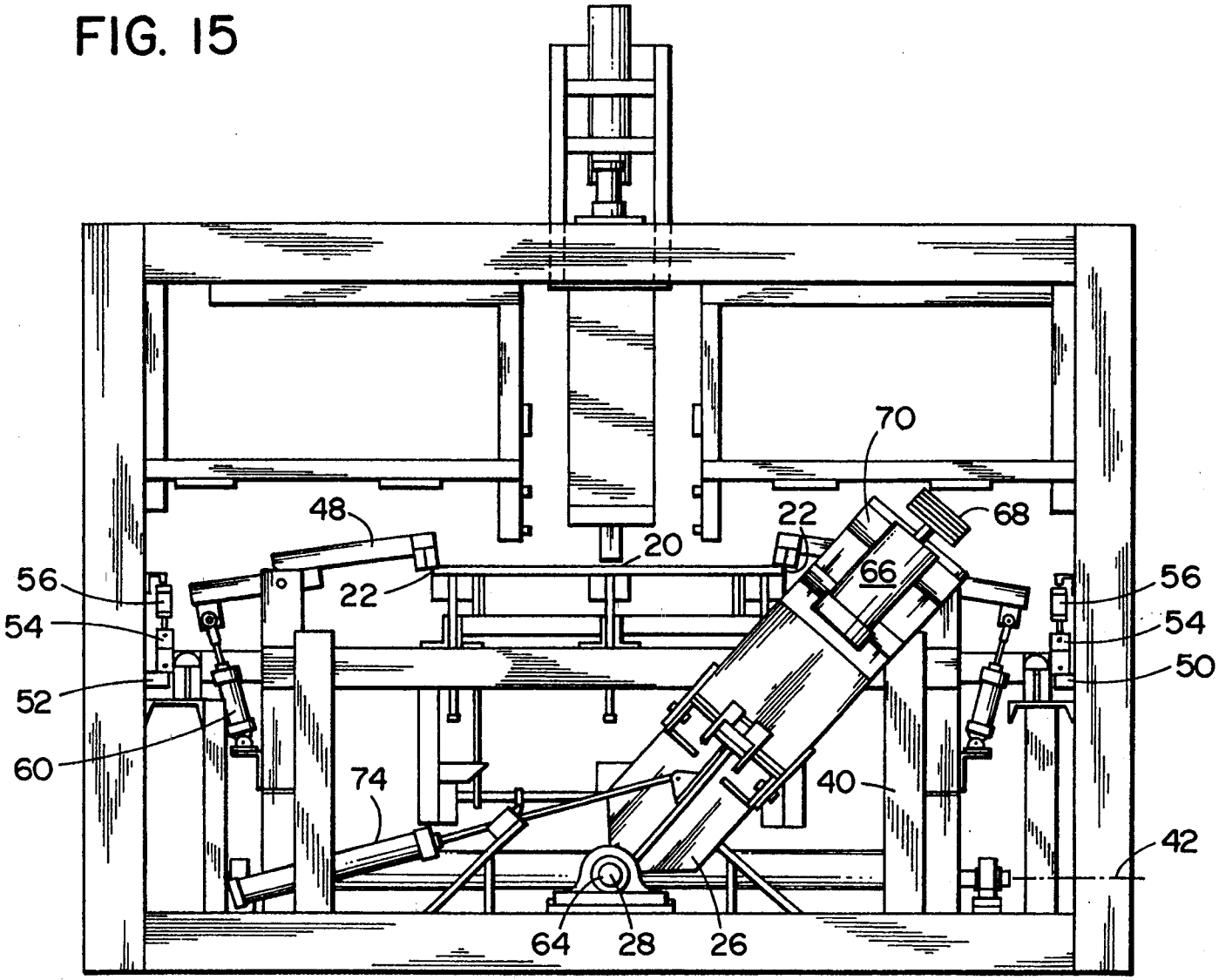
FIG. 15 is the same view as FIG. 13, but with the cutter head at the left end of the stave, having cut the stave.

FIG. 15 shows the cutter head 24 at the left of the machine, past the stave 12, after the stave 12 has been cut. At this point, after the cut is made, if the operator thinks that a little bit more material should be removed, he can push a control switch which causes the recut cams 54 to be lifted up, permitting the clamping frame 40 to rotate forward a bit more, and the cutter head 24 will then cut a bit more off the stave 12 as it returns to its starting position.

To set up the machine for operation, first the cutter head 24 is set at the desired angle to achieve the proper bilge. Then, a template is used to adjust the angle of the cradles 34, 36, 38 to achieve the correct flare angle.

To operate the machine, a stave blank is placed on the cradles 34, 36, 38 and against the left stop 58. The laser 62 shines a curved line down to show where the cut will be made in the wood, and the position of the stave blank is adjusted until the curved line shows the cut being made in the correct location. Then, the operator steps on a control switch, which causes the clamps 44, 46, 48 to clamp down on the stave blank and causes the cradle frame 40 to pivot forward about its axis 42 until it contacts the stops 50, 52. A sensor senses that the cradle frame 40 is in its forward position and causes the hydraulic cylinder 74 to start moving the pivot arm 26 from right to left.

The cutter head rotates, and the cutter blades 30 cut the stave as the pivot arm 26 pivots across the stave blank from right to left. At the left end, the portion of the cutter blades 30 in contact with the stave blank is closer to the longitudinal axis of the stave. As the cutter head pivots toward the midpoint 20 of the stave blank, the lower portion of the cutter blades contacts the stave. Since the lower portion of the cutter blades is farther away from the longitudinal axis of the stave, less material is cut away toward the midpoint. As the pivot arm 26 moves the cutter head toward the left end of the stave, again the upper portion of the cutter blades contacts the stave, cutting more material away at the ends 22.

The operator can look at the cut that has been made, and, if he thinks that more material should be cut away, he activates a control switch which causes the hydraulic cylinders 56 to lift up the cams 54, permitting the carriage frame 40 to rotate forward slightly. Then, as the pivot arm returns to the starting position at the right side of the machine, the cutter knives cut off a bit more material on the return run. If no additional material needs to be removed, the carriage frame is pivoted forward and the clamps are released so the stave blank can be released. The cutter head returns to the starting position.

The operator then turns the stave around to cut the edge that has not yet been cut and repeats the operation described above to cut that edge.

It will be obvious to those skilled in the art that modifications may be made to the embodiment described above without departing from the scope of the present invention.

What is claimed is:

1. A stave-cutting machine, comprising:

a clamping device for holding a stave in a fixed position while it is being cut so as to define a longitudinal stave axis, stave ends, and a stave midpoint;

a rotary cutter head having at least one cutter knife and mounted on a pivot arm which pivots about a pivot axis;

wherein said pivot axis is orthogonal to said longitudinal stave axis; and wherein, as said pivot arm pivots, said cutter knife traces out an imaginary portion of a conical surface, so as to define a bilge and a flare angle in the plane of the longitudinal stave axis so that, if a stave is held in said clamping device, said cutter knife will cut the bilge and flare angle into the stave.

2. A stave-cutting machine as recited in claim 1, wherein the pivoting of said pivot arm causes said cutter head to move along the clamping device from one said end, across said midpoint, and to the other said end, with the pivoting of said pivot arm causing the position of said cutter knife relative to said longitudinal axis to change, such that the portion of the cutter knife in contact with the stave is closer to the longitudinal axis at the ends and farther from the longitudinal axis at the midpoint.

3. A stave-cutting machine as recited in claim 2, wherein said cutter knife is at an angle to the pivot axis, said angle defining the angle of said imaginary partial conical surface.

4. A stave-cutting machine as recited in claim 1, and further comprising:

a movable clamping frame; a carriage member on said movable clamping frame for receiving a stave; and means for moving said clamping frame into and out of a fixed cutting position relative to the cutter head.

5. A stave-cutting machine as recited in claim 4, and further comprising:

a light source adapted to make a curved line on a stave clamped in said clamping frame when said clamping frame is out of the cutting position to show where the cut will be made when said clamping frame is moved into cutting position.

6. A stave-cutting machine, comprising:

a clamping device for holding a stave and defining an end and a midpoint;

a pivot arm mounted so as to pivot about a pivot axis which is in line with said midpoint;

a cutter head mounted on said pivot arm such that, as said pivot arm pivots, said cutter head is moved from one end of the stave, through the midpoint, to the other end of the stave, with the height of said cutter head relative to the stave changing as said pivot arm pivots;

wherein said cutter head includes cutter knives, and said cutter knives are at non-right-angles to said pivot axis, such that, when the height of said cutter head relative to said clamping device changes, it causes the distance from said cutter knives to the clamping device to change, so as to cut more material from the stave at the ends and less at the middle.

7. A stave-cutting machine as recited in claim 6, wherein said clamping device is mounted on a movable frame which defines a forward position, for putting the stave on and taking the stave off of the machine, and a rear position for cutting.

* * * * *